US012753969B2

(12) United States Patent
Park et al.

(10) Patent No.: US 12,753,969 B2
(45) Date of Patent: Oct. 6, 2026

(54) FREEZER DRIVING SYSTEM AND FREEZER DRIVE CONTROLLING METHOD

(71) Applicants: HYUNDAI MOTOR COMPANY, Seoul (KR); Kia Corporation, Seoul (KR)

(72) Inventors: Yunjoong Park, Hwaseong-si (KR); Jeongtaek Oh, Hwaseong-si (KR)

(73) Assignees: HYUNDAI MOTOR COMPANY, Seoul (KR); Kia Corporation, Seoul (KR)

( * ) Notice: Subject to any disclaimer, the term of this patent is extended or adjusted under 35 U.S.C. 154(b) by 19 days.

(21) Appl. No.: 18/956,888

(22) Filed: Nov. 22, 2024

(65) Prior Publication Data

US 2025/0354750 A1 Nov. 20, 2025

(30) Foreign Application Priority Data

May 17, 2024 (KR) ..... 10-2024-0064676

(51) Int. Cl.
*F25D 29/00* (2006.01)
*F25D 11/00* (2006.01)

(52) U.S. Cl.
CPC ..... *F25D 29/00* (2013.01); *F25D 11/003* (2013.01)

(58) Field of Classification Search
CPC ..... F25D 11/00; F25D 11/003; B60P 3/20; B60H 1/00807
See application file for complete search history.

(56) References Cited

U.S. PATENT DOCUMENTS

2022/0381473 A1* 12/2022 Enomoto ..... F25D 11/00
2023/0347714 A1* 11/2023 Charoulet ..... B60P 3/205

* cited by examiner

*Primary Examiner* — Elizabeth J Martin
(74) *Attorney, Agent, or Firm* — Banner & Witcoff, Ltd.

(57) ABSTRACT

Provided is a refrigeration vehicle system including a vehicle and a management server. The vehicle includes a refrigerator; a temperature controller configured to control a temperature of the refrigerator; and a refrigeration control terminal configured to: detect the temperature of the refrigerator; and generate, based on the temperature of the refrigerator deviating from a normal temperature range of the refrigerator, a first signal indicating a temperature deviation. The management server is configured to: determine, based on a temperature configuration for the refrigerator, the normal temperature range of the refrigerator; transmit, to the refrigeration control terminal, a second signal indicating the normal temperature range; receive, from the refrigeration control terminal, the first signal; and control, based on the first signal, the temperature controller in a remote management mode, to adjust the temperature of the refrigerator to be within the normal temperature.

15 Claims, 5 Drawing Sheets

FIG. 4

| CLASSIFICATION (EXAMPLE) | | MINIMUM TEMPERATURE VALUE | MAXIMUM TEMPERATURE VALUE |
|---|---|---|---|
| Type 1 (REFRIGERATED) | REFRIGERATED -GENERAL | 0 | 10 |
| | REFRIGERATED -FRESH CONVENIENCE | 0 | 5 |
| | REFRIGERATED -PROCESSED MEAT | -2 | 10 |
| | REFRIGERATED -POULTRY | -5 | -2 |
| Type 2 | FROZEN | -25 | -18 |
| Type N | ... | ... | ... |

FREEZER DRIVING SYSTEM AND FREEZER DRIVE CONTROLLING METHOD

CROSS-REFERENCE TO RELATED APPLICATION

This application claims priority to Korean Patent Application No. 10-2024-0064676, filed in the Korean Intellectual Property Office on May 17, 2024, the entire content of which is incorporated herein by reference.

TECHNICAL FIELD

The present disclosure relates to a refrigerated vehicle, and more specifically to a temperature controller of a refrigerated vehicle.

BACKGROUND

A freezer truck (also referred to as a refrigerated truck or a reefer truck) may provide a stand-alone operation environment by using a separate device controlling a freezer temperature of the freezer truck. However, this type of operation environment may present limitations for a user (e.g., a manager) when monitoring the freezer temperature.

In addition, controlling the freezer temperature by using the separate device may incur an additional cost because an additional device needs to be installed alongside an existing in-vehicle infotainment environment.

SUMMARY

The present disclosure attempts to provide a refrigeration vehicle system in which a server operates a temperature control unit of a freezer by using a connected environment without any separate device to control a temperature of the freezer installed in a vehicle, and a freezer drive controlling method.

According to one or more example embodiments of the present disclosure, a refrigeration vehicle system may include: a vehicle and a management server. The vehicle may include: a refrigerator; a temperature controller configured to control a temperature of the refrigerator; and a refrigeration control terminal configured to: detect the temperature of the refrigerator; and generate, based on the temperature of the refrigerator deviating from a normal temperature range of the refrigerator, a first signal indicating a temperature deviation. A management server may be configured to: determine, based on a temperature configuration for the refrigerator, the normal temperature range of the refrigerator; transmit, to the refrigeration control terminal, a second signal indicating the normal temperature range; receive, from the refrigeration control terminal, the first signal; and control, based on the first signal, the temperature controller in a remote management mode, to adjust the temperature of the refrigerator to be within the normal temperature.

The management server may be configured to determine the normal temperature range by: retrieving, from a database, a target temperature and a temperature deviation range that correspond to a vehicle model of the vehicle; and determining the normal temperature range based on the temperature deviation range centered around the target temperature.

The refrigeration control terminal may be further configured to: determine, based on a user input of a user of the vehicle, a target category selected from a plurality of cargo categories; and send, to the management server, an indication of the selected target category. The management server may be configured to determine the normal temperature range by: retrieving, from a database, a target temperature and a temperature deviation range that correspond to the selected target category; and determining the normal temperature range based on the temperature deviation range and the target temperature.

The management server may be further configured to: transmit, to the refrigeration control terminal and based on a determination that the temperature deviation has lasted for more than a first threshold time duration, a warning message indicating an impending execution of the remote management mode. The refrigeration control terminal may be configured to: display, via a user interface, the warning message.

The management server may be configured to control the temperature controller by: controlling the temperature controller in the remote management mode based on a determination that the refrigeration control terminal has not received any user input from a driver of the vehicle for more than a second threshold time duration since the warning message was transmitted to the refrigeration control terminal.

According to one or more example embodiments of the present disclosure, a method performed by a refrigeration vehicle system may include: determining, based on a temperature configuration for a refrigerator of a vehicle, a normal temperature range of the refrigerator of the vehicle; transmitting, to a refrigeration control terminal of the vehicle, an indication of the normal temperature range; receiving, from the refrigeration control terminal, an indication of a temperature deviation from the normal temperature range; and controlling, based on the indication of the temperature deviation, a temperature controller of the vehicle, in a remote management mode, to adjust a temperature of the refrigerator to be within the normal temperature range.

Transmitting the indication of the normal temperature range may include: retrieving, from a database, a target temperature and a temperature deviation range that correspond to a vehicle model of the vehicle; and determining the normal temperature range based on the temperature deviation range centered around the target temperature.

Transmitting the indication of the normal temperature range may include: receiving, from the refrigeration control terminal, a user input of a target category that is selected from a plurality of cargo categories; retrieving, from a database, a target temperature and a temperature deviation range that correspond to the selected target category; and determining the normal temperature range based on the temperature deviation range and the target temperature.

The method may further include: transmitting, to the refrigeration control terminal and based on a determination that the temperature deviation has lasted for more than a first threshold time duration, a warning message indicating an impending execution of the remote management mode.

Controlling the temperature controller may include: controlling the temperature controller in the remote management mode based on a determination that the refrigeration control terminal has not received any input from a driver of the vehicle for more than a second threshold time duration since the warning message was transmitted to the refrigeration control terminal.

According to one or more example embodiments of the present disclosure, a refrigeration vehicle management server may include a communication interface configured to communicate with a vehicle. The vehicle may include a refrigerator, a temperature controller configured to control a temperature of the refrigerator, and a refrigeration control terminal. The refrigeration vehicle management server may further include a controller configured to: determine, based on a temperature configuration for the refrigerator, a normal temperature range of the refrigerator of the vehicle; transmit, to the refrigeration control terminal, an indication of the normal temperature range; receive, from the refrigeration control terminal, an indication of a temperature deviation from the normal temperature range; and control, based on the indication of the temperature deviation, the temperature controller, in a remote management mode, to adjust a temperature of the refrigerator to be within the normal temperature range.

The controller may be configured to determine the normal temperature range by: retrieving, from a database, a target temperature and a temperature deviation range that correspond to a vehicle model of the vehicle; and determining the normal temperature range based on the temperature deviation range centered around the target temperature.

The controller may be configured to determine the normal temperature range by: receiving, from the refrigeration control terminal, a target category selected from a plurality of cargo categories; retrieving, from a database, a target temperature and a temperature deviation range that correspond to the selected target category; and determining the normal temperature range based on the temperature deviation range and the target temperature.

The controller may be further configured to: transmit, to the refrigeration control terminal and based on a determination that the temperature deviation has lasted for more than a first threshold time duration, a warning message indicating an impending execution of the remote management mode.

The controller may be configured to control the temperature controller by: controlling the temperature controller in the remote management mode based on a determination that the refrigeration control terminal has not received any user input for more than a second threshold time duration since the warning message was transmitted to the refrigeration control terminal.

BRIEF DESCRIPTION OF THE DRAWINGS

FIG. 4 shows an example of a case where a database shown in FIG. 1 includes a normal temperature range corresponding to each of a plurality of cargo categories as the minimum temperature value and the maximum temperature value.

DETAILED DESCRIPTION

Figure 1:
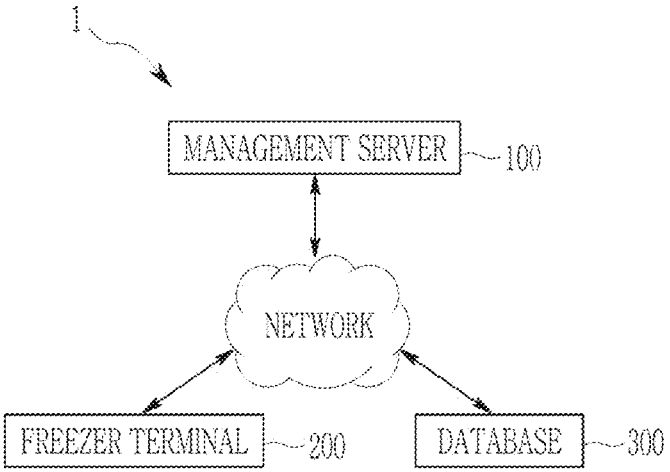
FIG. 1 is a block diagram schematically showing a configuration of a refrigeration vehicle system according to an embodiment.

Hereinafter, embodiments disclosed in the specification are described in detail with reference to the accompanying drawings, the same or similar components are denoted by the same or similar reference numerals, and an overlapping description thereof is omitted. Terms "module" and/or "unit" for components described in the following description are used only to make the specification easily understood. Therefore, these terms do not have meanings or roles distinguished from each other in themselves. Further, in describing the embodiments disclosed in the specification, omitted is a detailed description of a case where it is decided that the detailed description of the known art related to the present disclosure may obscure the gist of the present disclosure. Furthermore, it is to be understood that the accompanying drawings are provided only to allow the embodiments of the present disclosure to be easily understood, and the spirit of the present disclosure is not limited by the accompanying drawings and includes all the modifications, equivalents, and substitutions included in the spirit and scope of the present disclosure.

Terms including ordinal numbers such as "first", "second", and the like, may be used to describe various components. However, these components are not limited by these terms. These terms are used only to distinguish one component and another component from each other.

It is to be understood that terms "include", "have" and the like used in the present application specify the presence of features, numerals, steps, operations, components, parts or combinations thereof, mentioned in the specification, and do not preclude the presence or possible addition of one or more other features, numerals, steps, operations, components, parts or combinations thereof.

A program implemented as a set of instructions embodying a control algorithm necessary to control another configuration may be installed in a configuration for controlling another configuration under a specific control condition among configurations according to an embodiment. The control configuration may process input data and stored data based on the installed program to thus generate output data. The control configuration may include a non-volatile memory that stores the program and a memory that stores the data.

In the specification, a freezer may be a refrigerator or a freezer installed in a vehicle. The vehicle may be a freezer truck (e.g., a refrigeration vehicle, a refrigeration truck, etc.) installed with the freezer (e.g., a refrigerator) that freezes or refrigerates a cargo in the freezer truck.

FIG. 1 is a block diagram schematically showing a configuration of a refrigeration vehicle system according to an embodiment.

Referring to FIG. 1, a refrigeration vehicle system 1 according to an embodiment may include a management server 100, a freezer terminal 200, and a database 300. The management server 100, the freezer terminal 200, and the database 300 may be connected to each other through a network.

The refrigeration vehicle system 1 may control a temperature control unit of a freezer (hereinafter, "temperature control unit," "temperature controller," or "temperature regulator") in a connected environment. In the refrigeration vehicle system 1, the management server 100 may execute a management mode of controlling the temperature control unit. The management mode may also be referred to as a remote management mode. The management server may also be referred to as a remote server or a remote manager. In the management mode, a driver of the vehicle (e.g., the refrigeration vehicle) may be prevented from adjusting a temperature setting of the temperature control unit by using the freezer terminal 200. In other words, a user of the vehicle may be locked out of the temperature control unit. In the management mode (e.g., remote management mode), the management server 100 may turn on or off power of the freezer, and freezer temperature data may be uploaded to the management server 100 based on an event where the freezer temperature data is received from the freezer terminal 200. In the management mode, the management server 100 may drive (e.g., control) the temperature control unit based on data received in the past from the freezer terminal 200 and a driver feature (e.g., freezer temperature manipulation history).

The management server 100 may receive the freezer temperature data from the freezer terminal 200 and drive (e.g., control) the temperature control unit of the freezer. The management server 100 may be a vehicle management system (or a fleet management system (FMS)).

The freezer terminal 200 may detect the freezer temperature in real time and drive (e.g., control) the temperature control unit. The freezer terminal 200 may also be referred to as a freezer control interface, a freezer control terminal, a refrigeration control interface, a refrigeration control terminal, etc. The freezer terminal 200 may detect the freezer temperature in real time, and generate a real-time event that includes the freezer temperature (hereinafter, "real-time event" or "event"). Here, the real-time event may include an event such as a freezer state, a target temperature of the freezer temperature, or a freezer current temperature. The freezer terminal 200 may compare the real-time event with a normal temperature range of the freezer, and generate a temperature deviation event when a temperature deviation, in which the freezer temperature deviates from the normal temperature range, occurs. The temperature deviation event may include a time point at which the temperature deviation, in which the freezer temperature deviates from the normal temperature range, occurs.

The management server 100 may transmit a determined normal temperature range to the freezer terminal 200 by determining a normal temperature range corresponding to the freezer terminal 200. The management server 100 may receive the real-time event and the temperature deviation event from the freezer terminal 200, and determine whether to execute the management mode of driving (e.g., controlling) the temperature control unit based on the real-time event and the temperature deviation event. The management server 100 may monitor the driver feature and a temperature history based on the received real-time event.

Figure 2:
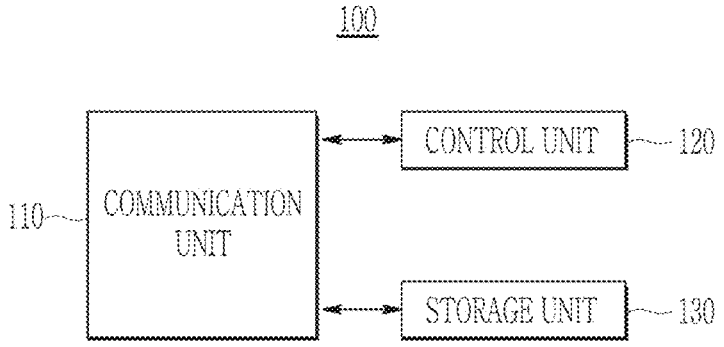
FIG. 2 is a block diagram showing in detail a function of a management server shown in FIG. 1.

FIG. 2 is a block diagram showing in detail a function of a management server shown in FIG. 1.

Referring to FIG. 2, the management server 100 may include a communication unit 110 (also referred to as a communication interface), a control unit 120 (also referred to as a controller), and a storage unit 130 (also referred to as storage). The communication unit 110 may be, for example, a modem, a network adapter, a radio transceiver, an antenna, etc., that is capable of communicating via one or more wired or wireless communication protocols, such as Ethernet, Wi-Fi, near-field communication (NFC), Bluetooth, Long-Term Evolution (LTE), 5G New Radio (NR), vehicle-to-everything (V2X), etc. A user interface may be A user interface may be a device through which a human user can interact with a device. The control unit 120 may be a controller that includes a communication device communicating with other controllers or a sensor to control one or more functions and/or operations in charge, a memory storing an operation system, a logic command, and input/output information, and/or one or more processors performing determination, calculation, and decision necessary for controlling the function in charge. A controller may include, for example, a processor, a central processing unit (CPU), a microchip, a logic, an application-specific integrated circuit (ASIC), memory, etc. A controller may manipulate and/or control other components in the system (e.g., vehicle). The temperature control unit 250 may regulate a temperature of the refrigerator. include, for example, a compressor, a motor, a thermostat, a thermometer, a refrigerant, a coolant, a radiator, a heat pump, a heater, a heating element, insulation, etc. The data storage unit 260 may be any volatile or non-volatile, transitory or non-transitory means of storing data or information. The data storage unit 130 may include, for example, memory, random-access memory (RAM), read-only memory (ROM), a cache, dynamic RAM (DRAM), static RAM (DRAM), electrically erasable and programmable ROM (EEPROM), flash memory, an optical disc, a compact disc ROM (CD-ROM), a magnetic disk, a hard drive, a solid-state drive (SSD), etc.

The communication unit 110 may communicate with the freezer terminal 200 and the database 300 through the network.

The control unit 120 may control the management server 100 overall, and execute the management mode by communicating with the freezer terminal 200 through the communication unit 110. For example, the control unit 120 may execute the management mode when determining that the temperature deviation event received from the freezer terminal 200 through the communication unit 110 lasts, and a manipulation signal for controlling the temperature control unit is not input to the freezer terminal 200 by the driver (e.g., a driver or passenger of the vehicle). The control unit 120 may store a freezer temperature history in the storage unit 130 based on the real-time event and the temperature deviation event. The control unit 120 may generate a temperature graph representing the freezer temperature history and transmit the same to the freezer terminal 200.

The storage unit 130 may store data, algorithms, or the like, necessary for the management server 100 to be operated. In an embodiment, the storage unit 130 may store an application that may remotely execute and control the management mode.

Figure 3:
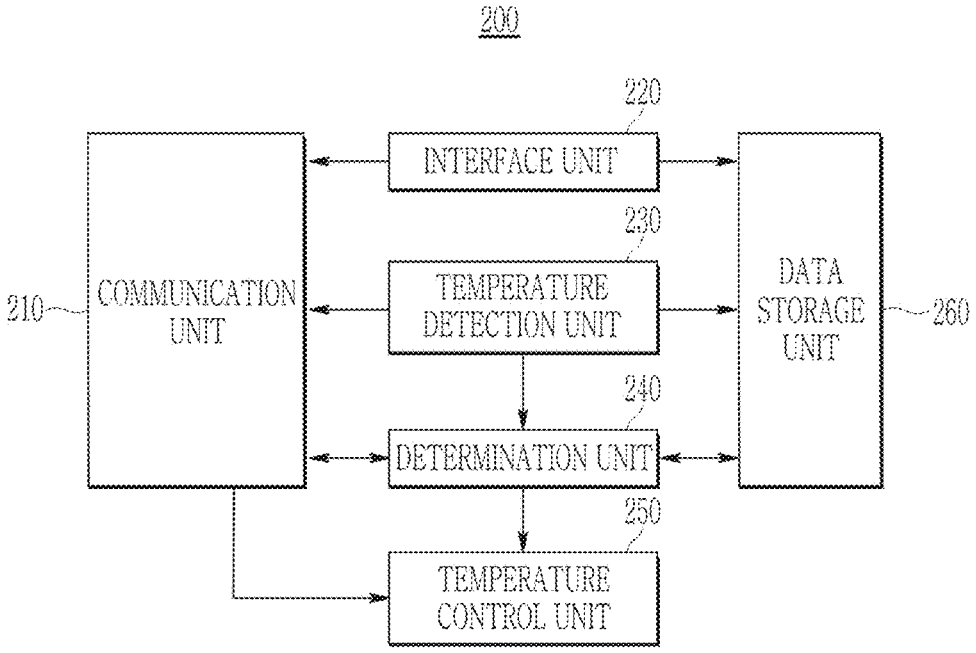
FIG. 3 is a block diagram showing in detail a function of a freezer terminal shown in FIG. 1.

FIG. 3 is a block diagram showing in detail a function of the freezer terminal shown in FIG. 1.

Referring to FIG. 3, the freezer terminal 200 may include a communication unit 210 (also referred to as a communication interface or a communication device), an interface unit 220 (also referred to as a user interface), a temperature detection unit 230 (also referred to as a temperature sensor), a determination unit 240 (also referred to as a controller), a temperature control unit 250 (also referred to as a temperature controller or a temperature regulator), and the data storage unit 260 (also referred to as data storage). The communication unit 210 may be, for example, a modem, a network adapter, a radio transceiver, an antenna, etc., that is capable of communicating via one or more wired or wireless communication protocols, such as Ethernet, Wi-Fi, near-field communication (NFC), Bluetooth, Long-Term Evolution (LTE), 5G New Radio (NR), vehicle-to-everything (V2X), etc. A user interface may be A user interface may be a device through which a human user can interact with a device. The interface unit 220 may include an input interface that can receive an input from the human user and/or an output interface through which data or information can be output to the human user. An input interface may include, for example, a button, a knob, a toggle, a switch, a dial, a slider, a keyboard, a touchscreen, a microphone, a camera, a wheel, a pedal, a lever, etc. An output interface may include, for example, a light, a lamp, an indicator, a screen, a display, a console, a meter, a gauge, a speaker, etc. The determination unit 240 may be a controller that includes a communication device communicating with other controllers or a sensor to control one or more functions and/or operations in charge, a memory storing an operation system, a logic command, and input/output information, and/or one or more processors performing determination, calculation, and decision necessary for controlling the function in charge. A controller may include, for example, a processor, a central processing unit (CPU), a microchip, a logic, an application-specific integrated circuit (ASIC), memory, etc. A controller may manipulate and/or control other components in the system (e.g., vehicle). The temperature control unit 250 may regulate a temperature of the refrigerator. include, for example, a compressor, a motor, a thermostat, a thermometer, a refrigerant, a coolant, a radiator, a heat pump, a heater, a heating element, insulation, etc. The data storage unit 260 may be any volatile or non-volatile, transitory or non-transitory means of storing data or information. The data storage unit 260 may include, for example, memory, random-access memory (RAM), read-only memory (ROM), a cache, dynamic RAM (DRAM), static RAM (DRAM), electrically erasable and programmable ROM (EEPROM), flash memory, an optical disc, a compact disc ROM (CD-ROM), a magnetic disk, a hard drive, a solid-state drive (SSD), etc.

The communication unit 210 may communicate with the management server 100 through the network. The communication unit 210 may receive the normal temperature range from the management server 100, and store the same in the data storage unit 260. In addition to or alternatively, the communication unit 210 may transmit the normal temperature range to the determination unit 240.

The interface unit 220 may output content representing in-vehicle infotainment on a screen. The interface unit 220 may receive a signal selected by the driver among a plurality of items related to the in-vehicle infotainment content.

The interface unit 220 may display a screen displaying freezer state data simultaneously with another infotainment content. The freezer state data may include an on/off state of the freezer, the freezer current temperature, a freezer target temperature, or the like. The interface unit 220 may provide a screen displaying the temperature graph received from the management server 100 through the communication unit 210.

The interface unit 220 may provide a screen through which the vehicle driver (or a vehicle passenger) may input one of a plurality of cargo categories. When the driver inputs one of the plurality of cargo categories, the interface unit 220 may store, in the data storage unit 260, one target category input by the driver (hereinafter, "the target category") among the plurality of cargo categories. The plurality of cargo categories according to an embodiment of the present disclosure may include refrigerated, frozen, fresh, or the like. For example, the plurality of cargo categories may include refrigerated-general, refrigerated-fresh convenience (or fresh produce), refrigerated-processed meat, refrigerated-poultry, and frozen. Here, the interface unit 220 may include a touch screen or the like. In addition, an embodiment of the present disclosure is not limited thereto, and the interface unit 220 may receive various data for checking the freezer temperature and driving the temperature control unit, such as the real-time freezer temperature and the normal temperature range. The interface unit 220 may transmit the target category to the communication unit 210.

In the specification, it is described that the interface unit 220 provides the screen through which one of the plurality of cargo categories may be input, and the vehicle driver inputs the target category, which is one of the plurality of cargo categories, to the interface unit 220, which is for convenience of description, and the present disclosure is not limited thereto.

In some embodiments, the interface unit 220 may provide a screen through which one of a plurality of items may be input, and the vehicle driver may input one of the plurality of items into the interface unit 220. In this case, the determination unit 240 may determine, categories as the target category, the cargo category corresponding to a product input through the interface unit 220 among the plurality of cargo categories.

The communication unit 210 may transmit the target category to the management server 100 through the network.

Referring to FIGS. 2 and 3, the control unit 120 may determine the normal temperature range by communicating with the database 300 through the communication unit 110. For example, the management server (e.g., the control unit 120) may determine the normal temperature range based on a temperature configuration for the refrigerator (e.g., the freezer). The temperature configuration may be stored in the database 300.

The database 300 may include, as the normal temperature range, one or more temperature configurations such as a target temperature and a temperature deviation range, corresponding to a vehicle model. In addition to or alternatively, the database 300 may include, as the normal temperature range, the target temperature and the temperature deviation range, corresponding to each of the plurality of cargo categories. For example, when the target temperature is 0 degrees and the temperature deviation range is 5 degrees, the normal temperature range may range from minus 5 degrees to plus 5 degrees, which is within a range of 5 degrees based on the target temperature of 0 degrees.

The control unit 120 may check the vehicle model indicated by the freezer terminal 200. The control unit 120 may retrieve, from the database 300, a first target temperature and a first temperature deviation range, corresponding to the vehicle model indicated by the freezer terminal 200. The control unit 120 may determine, as the normal temperature range, the freezer temperature within the first temperature deviation range based on the first target temperature based on a retrieval result from the database 300. In other words, the normal temperature range may be determined based on the first temperature deviation range centered around the first target temperature.

Alternatively, in some embodiments, the control unit 120 may retrieve, from the database 300, a second target temperature and a second temperature deviation range, corresponding to the target category, when the communication unit 110 receives the target category from the freezer terminal 200. The control unit 120 may determine, as the normal temperature range, the freezer temperature within the second temperature deviation range based on the second target temperature based on the retrieval result from the database 300.

The normal temperature range included in the database 300 is described as the target temperature and the temperature deviation range based on the vehicle model and/or the cargo category, which is for convenience of explanation and the present disclosure is not limited thereto. In some embodiments, the database 300 may represent the normal temperature range based on the vehicle model and/or the cargo category as the minimum temperature value and the maximum temperature value.

FIG. 4 shows an example of a case where the database shown in FIG. 1 includes the normal temperature range corresponding to each of the plurality of cargo categories as the minimum temperature value and the maximum temperature value.

Referring to FIG. 4, when the cargo category is "refrigerated" or "refrigerated-general", the normal temperature range may range from the minimum temperature value of 0 degrees to the maximum temperature value of 10 degrees. When the cargo category is "refrigerated" or "refrigerated-fresh convenience (or fresh produce)", the normal temperature range may range from the minimum temperature value of 0 degrees to the maximum temperature value of 5 degrees. When the cargo category is "refrigerated" or "refrigerated-meat processing", the normal temperature range may range from the minimum temperature value of minus 2 degrees to the maximum temperature value of 10 degrees. When the cargo category is "refrigerated" or "refrigerated poultry", the normal temperature range may range from the minimum temperature value of minus 5 degrees to the maximum temperature value of minus 2 degrees. When the cargo category is "frozen", the normal temperature range may range from the minimum temperature value of minus 25 degrees to the maximum temperature value of minus 18 degrees.

Referring again to FIG. 3, the temperature detection unit 230 may detect the freezer temperature, generate the real-time event based on the detected temperature, and store the generated real-time event in the data storage unit 260. The temperature detection unit 230 may transmit the real-time event to the communication unit 210. The communication unit 210 may transmit the real-time event to the management server 100 through the network.

The determination unit 240 may compare the real-time event with the normal temperature range, and generate the temperature deviation event when the freezer temperature included in the real-time event deviates from the normal temperature range. When the temperature deviation event is generated, the determination unit 240 may transmit the temperature deviation event to the management server 100 through the communication unit 210.

Referring again to FIG. 2, the control unit 120 may receive the temperature deviation event through the communication unit 110. The control unit 120 may transmit, to the freezer terminal 200, a warning instruction (e.g., a warning message) indicating that freezer temperature manipulation is necessary (hereinafter, "the warning instruction") when determining that the temperature deviation event lasts for a predetermined first reference time or longer. The warning instruction may indicate an impending execution of a remote management mode. The predetermined first reference time may be pre-stored as initial data in the storage unit 130. For example, when the temperature deviation event lasts for 10 minutes or longer, the control unit 120 may transmit the warning instruction to the freezer terminal 200 through the communication unit 110.

Referring again to FIG. 3, the interface unit 220 may display a screen showing a warning message based on the warning instruction when receiving the warning instruction from the management server 100 through the communication unit 210. The warning message may include content informing the driver that the temperature control unit needs to be controlled (e.g., controlled remotely).

The interface unit 220 may provide an interface through which the driver inputs the manipulation signal for manipulating the control of the temperature control unit (hereinafter, "manipulation signal" or "control command") based on the warning message. When the driver inputs the manipulation signal to the interface unit 220, the interface unit 220 may transmit a signal indicating that the manipulation signal is input to the management server 100 through the communication unit 210. When the driver inputs the manipulation signal to the interface unit 220, the interface unit 220 may transmit the manipulation signal to the determination unit 240.

The determination unit 240 may generate a signal for controlling the temperature control unit (hereinafter, "manipulation control signal") based on the manipulation signal, and transmit the same to the temperature control unit 250. The determination unit 240 may generate the manipulation control signal by comparing a manipulation temperature of the temperature control unit that is indicated by the manipulation signal with the freezer temperature included in the real-time event. For example, when the manipulation temperature of the temperature control unit that is indicated by the manipulation signal is lower than the freezer temperature included in the real-time event, the determination unit 240 may generate a signal for reducing a temperature of a coolant that cools a cooler as the manipulation control signal.

The temperature control unit 250 may control the temperature control unit based on the manipulation control signal received from the determination unit 240.

Referring to FIGS. 2 and 3, the control unit 120 may control the temperature control unit by executing the management mode when determining that the manipulation signal is not input to the interface unit 220 by the driver within a predetermined second reference time from a time point at which the communication unit 110 transmits the warning instruction to the freezer terminal 200. The predetermined second reference time may be pre-stored as initial data in the storage unit 130. For example, the control unit 120 may execute the management mode when the temperature deviation event lasts for 10 minutes or longer, and the manipulation signal is not input within 5 minutes after the interface unit 220 displays the screen indicating the warning message based on the warning instruction.

When the communication unit 110 receives, from the freezer terminal 200, the signal indicating that the manipulation signal is input, the control unit 120 may determine that the manipulation signal is input to the interface unit 220 by the driver. The control unit 120 may determine that the manipulation signal is not input to the interface unit 220 by the driver when the communication unit 110 does not receive the signal indicating that the manipulation signal is input from the freezer terminal 200 within the predetermined second reference time.

When executing the management mode, the control unit 120 may generate a signal for controlling the temperature setting for the temperature control unit (hereinafter, "the temperature management control signal") based on the determination of the management server 100, and transmit the same to the freezer terminal 200. The control unit 120 may generate the temperature management control signal by comparing the normal temperature range with the freezer temperature included in the real-time event. For example, when the freezer temperature included in the real-time event is higher than an upper limit of the normal temperature range, the control unit 120 may generate the signal for reducing the temperature of the coolant that cools the cooler as the temperature management control signal. When receiving the temperature management control signal from the management server 100, the communication unit 210 may transmit the same to the temperature control unit 250.

When the management server 100 executes the management mode, the temperature control unit 250 may control the temperature control unit based on the temperature management control signal received from the management server 100. When receiving the temperature management control signal from the management server 100 in the management mode, the temperature control unit 250 may transmit the same to the determination unit 240. The determination unit 240 may check the real-time event, the temperature deviation event, or the like, based on the temperature management control signal, and check a state or the like of the vehicle connected to the freezer terminal 200.

In this way, the temperature control unit 250 may reset its temperature based on the manipulation control signal or the temperature management control signal.

The data storage unit 260 may store data necessary for the freezer terminal 200 to be operated, algorithms, data received from the management server 100, or the like. In an embodiment, the data storage unit 260 may store an application that may operate the freezer terminal 200 based on remote control of the management server 100. The data storage unit 260 may store the temperature graph received from the management server 100 through the communication unit 210. The application stored in the data storage unit 260 may store the temperature graph received from the management server 100 in a non-removable memory or a removable universal serial bus (USB) storage device.

Figure 5:
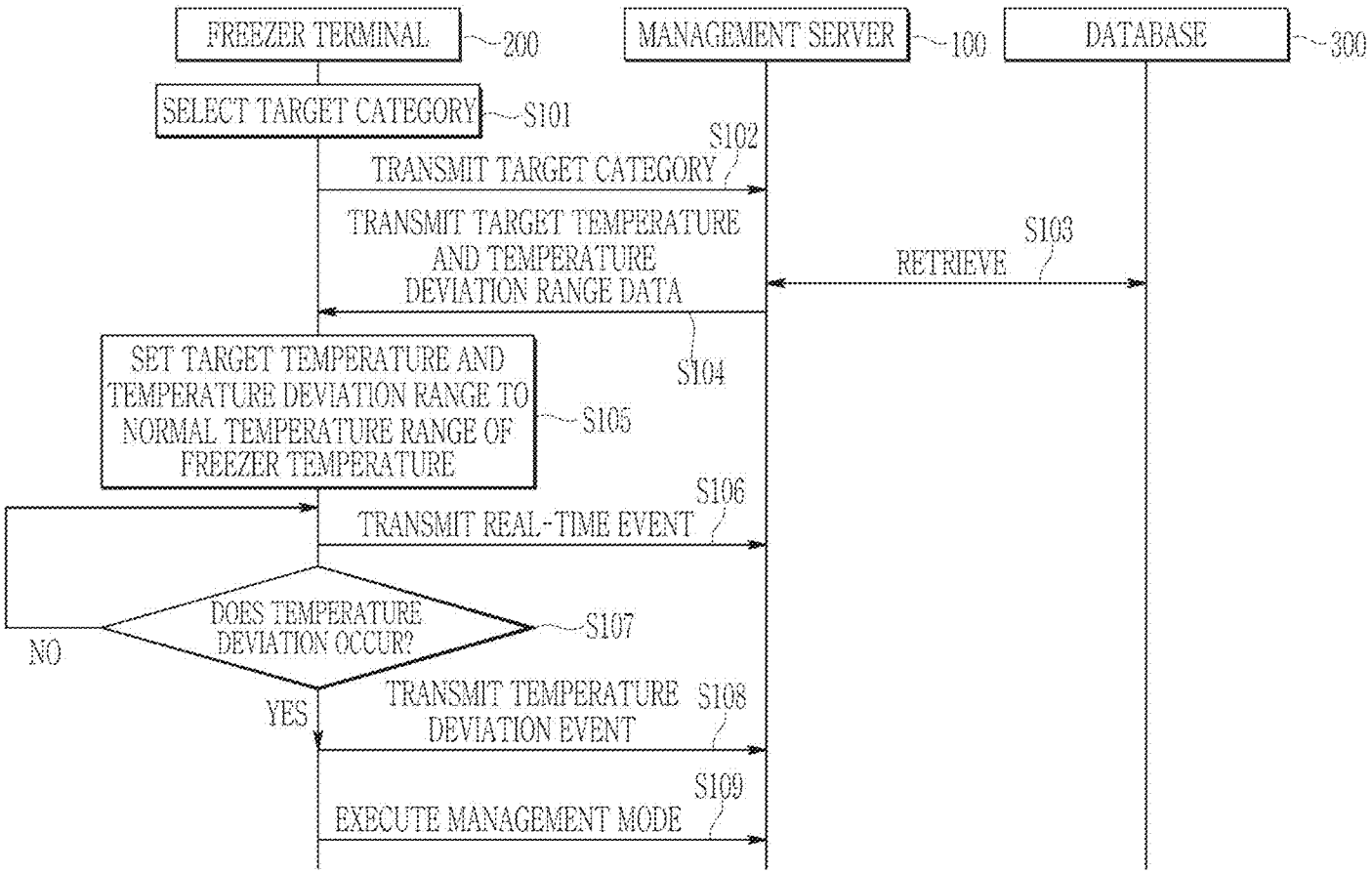
FIG. 5 is a flowchart of a refrigeration controlling method according to an embodiment.

FIG. 5 is a flowchart of a refrigeration controlling method according to an embodiment.

Hereinafter, the description may omit a description of a portion overlapping the description provided above among the descriptions of the management server 100, the freezer terminal 200, and the database 300.

Referring to FIG. 5, the driver may select the target category, which is one of the plurality of cargo categories, as the cargo category (S101). The driver may input the selected target category into the interface unit 220 of the freezer terminal 200.

The freezer terminal 200 may transmit the target category to the management server 100 (S102).

When receiving the target category from the freezer terminal 200, the management server 100 may retrieve, from the database 300, the target temperature and the temperature deviation range, corresponding to the target category (S103).

The management server 100 may transmit, to the freezer terminal 200, the target temperature and the temperature deviation range data, based on the retrieval result in step S103 (S104).

The freezer terminal 200 may set the target temperature and the temperature deviation range, received from the management server 100, to the normal temperature range of the freezer temperature (S105).

The freezer terminal 200 may generate a real-time event by detecting the freezer temperature in real time and transmit the generated real-time event to the management server 100 (S106).

The freezer terminal 200 may determine whether the temperature deviation, in which the freezer temperature deviates from the normal temperature range, occurs (S107).

When determining that the temperature deviation occurs in step S107 (Yes in S107), the freezer terminal 200 may generate the temperature deviation event and transmit the same to the management server 100 (S108).

When determining that no temperature deviation occurs in step S107 (No in S107), the freezer terminal 200 may perform step S106.

Following step S108, the management server 100 may execute the management mode for the freezer terminal 200 (S109) when the temperature deviation event lasts for a predetermined time or longer. When executing the management mode, the management server 100 may transmit the temperature management control signal to the freezer terminal 200. The temperature control unit 250 may control the temperature control unit based on the temperature management control signal.

Here, a condition for the management server 100 to execute the management mode may indicate a case where the temperature deviation event lasts for the predetermined time or more. Alternatively, in some embodiments, as described above, the condition for the management server 100 to execute the management mode may indicate the case where the warning instruction is transmitted to the freezer terminal 200 when the temperature deviation event lasts for the predetermined first reference time or longer, and the signal indicating that the manipulation signal is input is not received from the freezer terminal 200 within the predetermined second reference time from the time point at which the warning instruction is transmitted. In addition, the embodiments of the present disclosure are not limited thereto, and the management server 100 may execute the management mode based on the data including the temperature deviation event duration, the manipulation signal input to the freezer terminal 200, or the like.

According to an embodiment, provided is a freezer driving system, which drives a temperature control unit of a freezer installed in a vehicle, the system including: a freezer terminal detecting a freezer temperature in real time and generating a real-time event that includes the freezer temperature, comparing the real-time event with a normal temperature range of the freezer, and generating a temperature deviation event when the freezer temperature deviates from the normal temperature range; and a management server transmitting a determined normal temperature range to the freezer terminal by determining a normal temperature range, receiving the real-time event and the temperature deviation event from the freezer terminal, and determining whether to execute a management mode of driving the temperature control unit based on the real-time event and the temperature deviation event.

The management server retrieves, from a database, a first target temperature and a first temperature deviation range, corresponding to a vehicle model, and determines, as the normal temperature range, the freezer temperature within the first temperature deviation range based on the first target temperature.

The freezer terminal may receive a target category among a plurality of cargo categories from a vehicle driver, and the management server may retrieve, from the database, a second target temperature and a second temperature deviation range, corresponding to the target category, when receiving the target category from the freezer terminal, and determine, as the normal temperature range, the freezer temperature within the second temperature deviation range based on the second target temperature.

The management server may transmit, to the freezer terminal, a warning instruction indicating that freezer temperature manipulation is necessary when determining that the temperature deviation event lasts for a predetermined first reference time or longer, and the freezer terminal may display a screen showing a warning message based on the warning instruction by using an interface unit when receiving the warning instruction from the management server.

The management server may drive the temperature control unit by executing the management mode when determining that a manipulation signal for manipulating the driving of the temperature control unit is not input to the interface unit by a vehicle driver within a predetermined second reference time from a time point at which the warning instruction is transmitted to the freezer terminal.

According to an embodiment, provided is a freezer drive controlling method of driving a temperature control unit of a freezer installed in a vehicle, the method including: generating, by a freezer terminal, a real-time event that includes a freezer temperature of the freezer that is detected in real time; transmitting, by a management server, a determined normal temperature range to the freezer terminal by determining a normal temperature range of the freezer; receiving, by the management server, the real-time event from the freezer terminal; receiving, by the management server, a temperature deviation event from the freezer terminal when the freezer temperature deviates from the normal temperature range; and determining, by the management server, whether to execute a management mode of driving the temperature control unit based on the real-time event and the temperature deviation event.

The transmitting, by the management server, of the determined normal temperature range to the freezer terminal by determining the normal temperature range of the freezer may include: retrieving, from a database, a first target temperature and a first temperature deviation range, corresponding to a vehicle model; and determining, as the normal temperature range, the freezer temperature within the first temperature deviation range based on the first target temperature.

The method may further include receiving, by the freezer terminal, a target category among a plurality of cargo categories from a vehicle driver, wherein the transmitting, by the management server, of the determined normal temperature range to the freezer terminal by determining the normal temperature range of the freezer includes retrieving, from the database, a second target temperature and a second temperature deviation range, corresponding to the target category, when the target category is received from the freezer terminal, and determining, as the normal temperature range, the freezer temperature within the second temperature deviation range based on the second target temperature.

The method may further include: transmitting, by the management server, to the freezer terminal, a warning instruction indicating that freezer temperature manipulation is necessary when it is determined that the temperature deviation event lasts for a predetermined first reference time or longer; and displaying, by the freezer terminal, a screen showing a warning message based on the warning instruction by using an interface unit when the warning instruction is received from the management server.

The method further comprising driving, by the management server, the temperature control unit by executing the management mode when it is determined that a manipulation signal for manipulating the driving of the temperature control unit is not input to the interface unit by a vehicle driver within a predetermined second reference time from a time point at which the warning instruction is transmitted to the freezer terminal.

As set forth above, according to the present disclosure, it is possible to control the temperature control unit of the freezer in the connected environment without any separate device, thereby reducing the cost which may be incurred by using the separate device.

According to the present disclosure, in providing the service of the vehicle management system (or the fleet management system (FMS)) by utilizing the connected environment, the management server may also control the temperature control unit of the freezer to thus manage the temperatures of the freezers installed in the plurality of vehicles, thereby improving the management convenience and the cargo quality.

According to the present disclosure, it is possible to remotely control the freezer temperature to the normal temperature range corresponding to the cargo category in the management mode, thereby reducing the stress for the driver to have to control the freezer temperature, and reducing the driver's burden on controlling the freezer temperature.

Although the embodiments of the present disclosure have been described in detail hereinabove, the scope of the present disclosure is not limited thereto. Various modifications and improvements made by those skilled in the art to which the present disclosure pertains also belong to the scope of the present disclosure.

What is claimed is:

1. A refrigeration vehicle system comprising:
- a vehicle comprising:
  - a refrigerator;
  - a temperature controller configured to control a temperature of the refrigerator; and
  - a refrigeration control terminal configured to:
    - detect the temperature of the refrigerator; and
    - generate, based on the temperature of the refrigerator deviating from a normal temperature range of the refrigerator, a first signal indicating a temperature deviation; and
- a management server configured to:
  - determine, based on a temperature configuration for the refrigerator, the normal temperature range of the refrigerator;
  - transmit, to the refrigeration control terminal, a second signal indicating the normal temperature range;
  - receive, from the refrigeration control terminal, the first signal; and
  - control, based on the first signal, the temperature controller in a remote management mode, to adjust the temperature of the refrigerator to be within the normal temperature range.

2. The refrigeration vehicle system of claim 1, wherein the management server is configured to determine the normal temperature range by:
- retrieving, from a database, a target temperature and a temperature deviation range that correspond to a vehicle model of the vehicle; and
- determining the normal temperature range based on the temperature deviation range centered around the target temperature.

3. The refrigeration vehicle system of claim 1, wherein the refrigeration control terminal is further configured to:
- determine, based on a user input of a user of the vehicle, a target category selected from a plurality of cargo categories; and
- send, to the management server, an indication of the selected target category, and
- wherein the management server is configured to determine the normal temperature range by:
  - retrieving, from a database, a target temperature and a temperature deviation range that correspond to the selected target category; and
  - determining the normal temperature range based on the temperature deviation range and the target temperature.

4. The refrigeration vehicle system of claim 1, wherein the management server is further configured to:
- transmit, to the refrigeration control terminal and based on a determination that the temperature deviation has lasted for more than a first threshold time duration, a warning message indicating an impending execution of the remote management mode, and wherein the refrigeration control terminal is configured to: display, via a user interface, the warning message.

5. The refrigeration vehicle system of claim 4, wherein the management server is configured to control the temperature controller by:

controlling the temperature controller in the remote management mode based on a determination that the refrigeration control terminal has not received any user input from a driver of the vehicle for more than a second threshold time duration since the warning message was transmitted to the refrigeration control terminal.

6. A method performed by a refrigeration vehicle system, the method comprising:

determining, based on a temperature configuration for a refrigerator of a vehicle, a normal temperature range of the refrigerator of the vehicle;

transmitting, to a refrigeration control terminal of the vehicle, an indication of the normal temperature range;

receiving, from the refrigeration control terminal, an indication of a temperature deviation from the normal temperature range; and controlling, based on the indication of the temperature deviation, a temperature controller of the vehicle, in a remote management mode, to adjust a temperature of the refrigerator to be within the normal temperature range.

7. The method of claim 6, wherein the transmitting of the indication of the normal temperature range comprises:

retrieving, from a database, a target temperature and a temperature deviation range that correspond to a vehicle model of the vehicle; and determining the normal temperature range based on the temperature deviation range centered around the target temperature.

8. The method of claim 6, wherein the transmitting of the indication of the normal temperature range comprises:

receiving, from the refrigeration control terminal, a user input of a target category that is selected from a plurality of cargo categories;

retrieving, from a database, a target temperature and a temperature deviation range that correspond to the selected target category; and determining the normal temperature range based on the temperature deviation range and the target temperature.

9. The method of claim 6, further comprising:

transmitting, to the refrigeration control terminal and based on a determination that the temperature deviation has lasted for more than a first threshold time duration, a warning message indicating an impending execution of the remote management mode.

10. The method of claim 9, wherein the controlling the temperature controller comprises:

controlling the temperature controller in the remote management mode based on a determination that the refrigeration control terminal has not received any input from a driver of the vehicle for more than a second threshold time duration since the warning message was transmitted to the refrigeration control terminal.

11. A refrigeration vehicle management server comprising:

a communication interface configured to communicate with a vehicle, wherein the vehicle comprises a refrigerator, a temperature controller configured to control a temperature of the refrigerator, and a refrigeration control terminal; and a controller configured to:

determine, based on a temperature configuration for the refrigerator, a normal temperature range of the refrigerator of the vehicle;

transmit, to the refrigeration control terminal, an indication of the normal temperature range;

receive, from the refrigeration control terminal, an indication of a temperature deviation from the normal temperature range; and control, based on the indication of the temperature deviation, the temperature controller, in a remote management mode, to adjust a temperature of the refrigerator to be within the normal temperature range.

12. The refrigeration vehicle management server of claim 11, wherein the controller is configured to determine the normal temperature range by:

retrieving, from a database, a target temperature and a temperature deviation range that correspond to a vehicle model of the vehicle; and determining the normal temperature range based on the temperature deviation range centered around the target temperature.

13. The refrigeration vehicle management server of claim 11, wherein the controller is configured to determine the normal temperature range by:

receiving, from the refrigeration control terminal, a target category selected from a plurality of cargo categories;

retrieving, from a database, a target temperature and a temperature deviation range that correspond to the selected target category; and determining the normal temperature range based on the temperature deviation range and the target temperature.

14. The refrigeration vehicle management server of claim 11, wherein the controller is further configured to:

transmit, to the refrigeration control terminal and based on a determination that the temperature deviation has lasted for more than a first threshold time duration, a warning message indicating an impending execution of the remote management mode.

15. The refrigeration vehicle management server of claim 14, wherein the controller is configured to control the temperature controller by:

controlling the temperature controller in the remote management mode based on a determination that the refrigeration control terminal has not received any user input for more than a second threshold time duration since the warning message was transmitted to the refrigeration control terminal.

* * * * *